US008810355B2

(12) United States Patent
Mieczkowski et al.

(10) Patent No.: US 8,810,355 B2
(45) Date of Patent: Aug. 19, 2014

(54) THIN FILM RESISTOR

(71) Applicant: Cree, Inc., Durham, NC (US)

(72) Inventors: Van Mieczkowski, Apex, NC (US); Jason Gurganus, Raleigh, NC (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 14/039,250

(22) Filed: Sep. 27, 2013

(65) Prior Publication Data

US 2014/0022048 A1 Jan. 23, 2014

Related U.S. Application Data

(63) Continuation-in-part of application No. 13/153,041, filed on Jun. 3, 2011, now Pat. No. 8,570,140.

(51) Int. Cl.
*H01C 1/012* (2006.01)

(52) U.S. Cl.
USPC ..... 338/308; 338/309

(58) Field of Classification Search
USPC ..... 338/308, 309
See application file for complete search history.

(56) References Cited

U.S. PATENT DOCUMENTS

| | | | | |
|---|---|---|---|---|
| 3,301,707 | A | 1/1967 | Loeb et al. | |
| 4,259,564 | A * | 3/1981 | Ohkubo et al. | 347/208 |
| 5,468,672 | A * | 11/1995 | Rosvold | 438/385 |
| 7,129,552 | B2 * | 10/2006 | Gao et al. | 257/411 |
| 2011/0128692 | A1 * | 6/2011 | Gaul et al. | 361/679.31 |

FOREIGN PATENT DOCUMENTS

| | | | |
|---|---|---|---|
| EP | 0447496 | A1 | 9/1991 |
| JP | 03262101 | B2 | 11/1991 |
| JP | 04296088 | B2 | 10/1992 |

OTHER PUBLICATIONS

International Search Report for PCT/US2012/040359, mailed Sep. 10, 2012, 10 pages.
Restriction Requirement for U.S. Appl. No. 13/153,041, mailed Nov. 5, 2012, 6 pages.
Non-Final Office Action for U.S. Appl. No. 13/153,041, mailed Jan. 29, 2013, 6 pages.
Notice of Allowance for U.S. Appl. No. 13/153,041, mailed Jun. 27, 2013, 8 pages.

* cited by examiner

*Primary Examiner* — Kyung Lee
(74) *Attorney, Agent, or Firm* — Withrow & Terranova, P.L.L.C.

(57) ABSTRACT

The present disclosure relates to a thin film resistor that is formed on a substrate along with other semiconductor devices to form all or part of an electronic circuit. The thin film resistor includes a resistor segment that is formed over the substrate and a protective cap that is formed over the resistor segment. The protective cap is provided to keep at least a portion of the resistor segment from oxidizing during fabrication of the thin film resistor and other components that are provided on the semiconductor substrate. As such, no oxide layer is formed between the resistor segment and the protective cap. Contacts for the thin film resistor may be provided at various locations on the protective cap, and as such, are not provided solely over a portion of the resistor segment that is covered with an oxide layer.

16 Claims, 7 Drawing Sheets

THIN FILM RESISTOR

RELATED APPLICATION

The present application is a divisional application under 35 U.S.C. §121 of U.S. application Ser. No. 13/153,041, entitled THIN FILM RESISTOR, which was filed on Jun. 3, 2011, now a U.S. Pat. No. 8,570,140, issued Oct. 29,2013, the disclosure of which is hereby incorporated herein in its entirety by reference.

FIELD OF THE DISCLOSURE

The present disclosure relates to thin film resistors and a method for making the same.

BACKGROUND

Thin film resistors are generally resistors that are formed on a semiconductor substrate using a thin-film deposition process. An exemplary thin film resistor 10 is illustrated in FIG. 1. As depicted, the thin film resistor 10 is formed on a substrate 12 and is shown having metallic interconnects 14 extending from either side of the thin film resistor 10. The substrate 12 may be formed from a wafer and is used as a foundation on which one or more semiconductor devices, such as transistors and diodes, are formed. The interconnects 14 are used to connect either side of the thin film resistor 10 to other electrical components, such as other resistors, inductors, capacitors, transistors, diodes, and the like in an overall circuit that is formed at least in part on the substrate 12. While the interconnects 14 are shown on either side of the thin film resistor 10, the interconnects 14 may be provided entirely or substantially above and below the thin film resistor 10.

In certain applications, the resistance provided between the interconnects 14 by the thin film resistor 10 is critical to the overall performance of the circuit in which the thin film resistor 10 resides. The circuit may be designed to require a resistor with very tight tolerances, and if the resistance provided by the thin film resistor 10 falls outside of a set tolerance, the circuit may not perform as desired. As such, it is important to form the thin film resistor 10 such that the resistance provided between the interconnects 14, or two other contact points, is highly controllable and repeatable during fabrication of the overall circuit on the substrate 12.

Unfortunately, the material from which thin film resistor 10 is formed is prone to oxidizing, and oxidation occurs before the interconnects 14 are formed during the fabrication process. The oxidation results in an oxide layer 16 forming over the exposed surface of the thin film resistor 10 before the interconnects are formed. The oxide layer 16 effectively raises the interlevel contact resistance between the thin film resistor 10 and the interconnects 14, and as a result, the actual resistance provided between the interconnects 14 by the thin film resistor 10 can be significantly different than the desired resistance. While the oxide layer 16 may be removed using various acid-based cleaning steps, such cleaning steps may unintentionally erode or harm other structures that were previously formed on the substrate.

Further, semiconductor fabrication generally involves numerous deposition, etching, and cleaning iterations as the various layers and devices are formed on the substrate 12. As such, numerous etching and cleaning steps may be required after the thin film resistor 10 is formed. These etching and cleaning steps may erode portions of the thin film resistor 10.

Erosion of the thin film resistor 10 also has a significant impact on the resistance provided by the thin film resistor 10 between the interconnects 14.

Accordingly, there is a need for a technique that will substantially protect thin film resistors 10 from the undesirable effects of oxidation during fabrication, such that the thin film resistors 10 can be repeatedly formed to provide resistances within relatively tight tolerances. There is a further need for a technique that will substantially protect thin film resistors 10 from erosion during fabrication.

SUMMARY

The present disclosure relates to a thin film resistor that is formed on a substrate along with other semiconductor devices to form all or part of an electronic circuit. The thin film resistor includes a resistor segment that is formed over the substrate and a protective cap that is formed over the resistor segment. The protective cap is provided to keep at least a portion of the resistor segment from oxidizing during fabrication of the thin film resistor and other components that are provided on the semiconductor substrate. As such, no oxide layer is formed between the resistor segment and the protective cap. Contacts for the thin film resistor may be provided at various locations on the protective cap, and as such, are not provided solely over a portion of the resistor segment that is covered with an oxide layer.

In one embodiment, the thin film resistor may be formed on the substrate by depositing a resistor material to form a resistor layer and then depositing a protective cap material over the resistor layer to form a protective cap layer prior to any subsequent fabrication process that would cause the resistor material to oxidize. The thin film resistor is formed by removing unwanted portions of the resistor layer and the protective cap layer, wherein the removal of these layers may take place in the same removal process or different removal processes. The removal processes may include etching, lift-off, or like removal processes. In one embodiment, the subsequent fabrication process that would cause the resistor material to oxidize is an ashing process.

In this embodiment, the resistor material is deposited under vacuum and the protective cap material is deposited prior to releasing the vacuum. In essence, the protective cap material of the thin film resistor forms a protective cap and has a first surface such that a first interconnect may be formed having a first end in contact with at least a first portion of the first surface. A second interconnect may also be formed having a second end in contact with at least a second portion of the first surface, wherein a majority of current flowing through the thin film resistor will flow through a resistor segment formed by the resistor material.

In certain embodiments, the resistor material is prone to oxidation, and the protective cap material is not prone to oxidation. The protective cap material may include or consist essentially of platinum. The resistor material may include one of a group consisting of nickel, chromium, and nichrome. In certain embodiments, a thickness of the protective cap material of the thin film resistor is less than about 15% of a combined thickness of the protective cap material and the resistor material. In certain embodiments, a thickness of the resistor material of the thin film resistor is greater than about 85% of a combined thickness of the protective cap material and the resistor material. For example, the resistor material of the thin film resistor may between about 800 and 1000 Angstroms thick while the protective cap material may be less than about 100 Angstroms thick.

Those skilled in the art will appreciate the scope of the disclosure and realize additional aspects thereof after reading the following detailed description in association with the accompanying drawings.

BRIEF DESCRIPTION OF THE DRAWINGS

The accompanying drawings incorporated in and forming a part of this specification illustrate several aspects of the disclosure, and together with the description serve to explain the principles of the disclosure.

DETAILED DESCRIPTION

The embodiments set forth below represent the necessary information to enable those skilled in the art to practice the disclosure and illustrate the best mode of practicing the disclosure. Upon reading the following description in light of the accompanying drawings, those skilled in the art will understand the concepts of the disclosure and will recognize applications of these concepts not particularly addressed herein. It should be understood that these concepts and applications fall within the scope of the disclosure and the accompanying claims. When an element such as a layer, sublayer, structure, portion, region or substrate is referred to as being "on" or extending "onto" another element, it can be directly on or extend directly onto the other element, or intervening elements may also be provided. In contrast, if an element is referred to as being "directly on" or extending "directly onto" another element, there are no intervening elements present. Further, complementary conductivity configurations are available for each embodiment.

Figure 1:
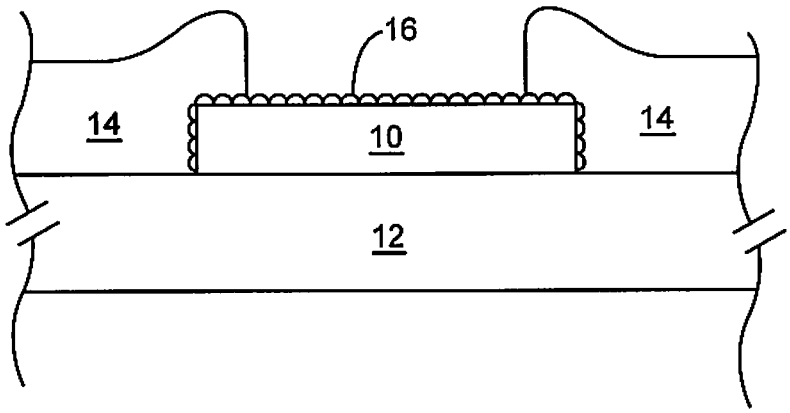
FIG. 1 (RELATED ART)
FIG. 1 illustrates a thin film resistor from related art.

Prior to delving into the details of the disclosed embodiments, a current fabrication process for forming a circuit with a thin film resistor is described. The fabrication process is one in which the thin film resistor 10 of FIG. 1 is formed. As depicted in FIG. 1, the thin film resistor 10 is formed on the substrate 12 and is shown as having metallic interconnects 14 extending from either side of the thin film resistor 10. As discussed above, the process for forming the thin film resistor 10 leaves an undesirable oxide layer 16 on the exposed portions of the thin film resistor 10 prior to the interconnects 14 being formed. The oxide layer 16 effectively raises the inter-level contact resistance between the thin film resistor 10 and the interconnects 14, and as a result, the actual resistance provided between the interconnects 14 by the thin film resistor 10 can be significantly different than the desired resistance. In the following example, two thin film resistors 10 are formed beside each other and will ultimately be connected to each other and to other components (not shown) using corresponding interconnects 14. Such an embodiment may be employed in a voltage divider circuit.

Figure 2:
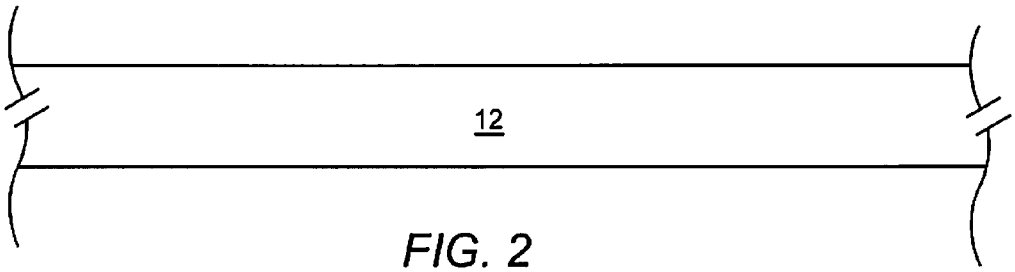
FIG. 2 (RELATED ART)
FIGS. 2 through 8 graphically illustrate a fabrication process for forming the thin film resistor of FIG. 1.
Figure 3:
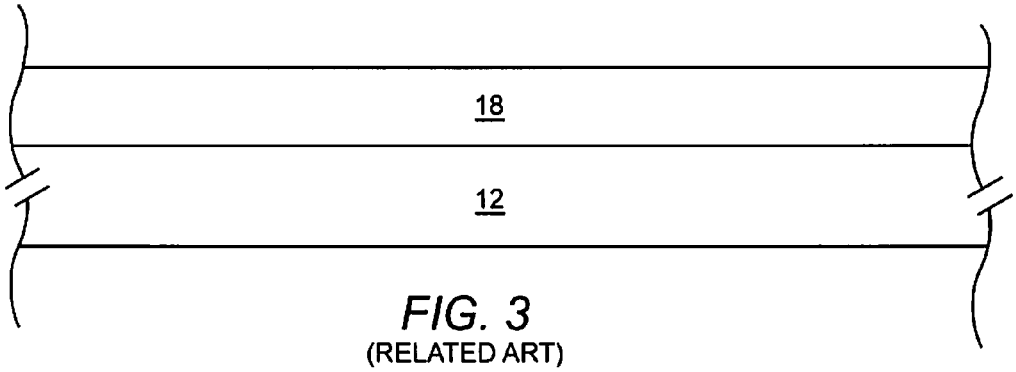
FIG. 3 (RELATED ART)
Figure 4:
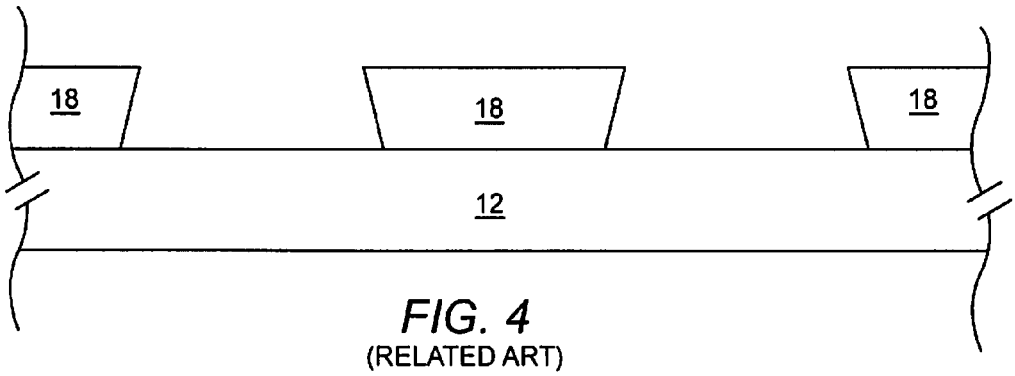
FIG. 4 (RELATED ART)

Initially, the fabrication process begins with providing a substrate 12, such as a Silicon Carbide, Gallium Nitride, Gallium Arsenide, or like substrate, as shown in FIG. 2. A lithography process is then used to form the thin film resistor 10. In this example, the lithography process employed is a photolithography process where a photosensitive resist material is initially deposited over the substrate 12 to provide a resist layer 18, as shown in FIG. 3. Next, the resist layer 18 is irradiated with light that is projected through a photomask, which is essentially a stencil that defines the locations where the thin film resistors 10 will be formed. For a positive photoresist material, the irradiated areas become soluble when exposed to a developer solution and the non-irradiated areas remain insoluble when exposed to the developer solution. After irradiation, the resist layer 18 is exposed to the developer solution to remove the irradiated portions that correspond to the locations where the thin film resistors 10 will be formed. The resulting openings in the resist layer 18 for the thin film resistors 10 are shown in FIG. 4.

Figure 5:
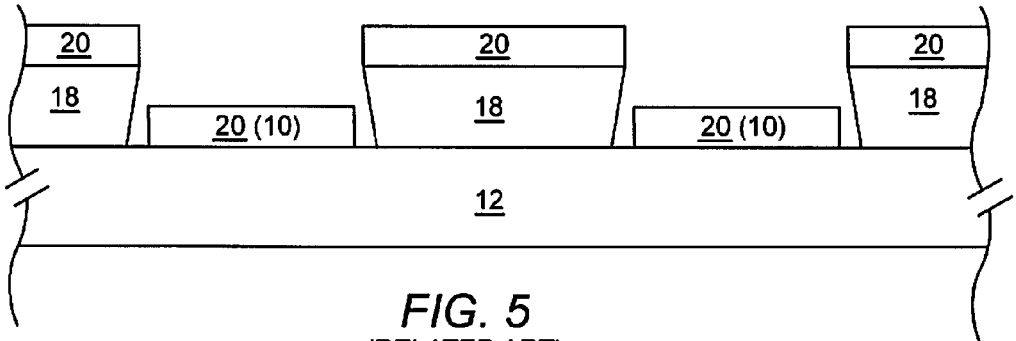
FIG. 5 (RELATED ART)

Next, resistor material is deposited over the resist layer 18 and those portions of the substrate 12 that are exposed through the openings in the resist layer 18. The deposited resistor material forms a thin film resistor layer 20, as illustrated in FIG. 5. A typical resistor material is formed from Chromium (Cr), Nickel (Ni), or Nichrome (NiCr), which is an alloy of Nickel and Chromium. Other resistor materials include, but are not limited to titanium (Ti), gold-germanium-nickel alloy (AuGeNi), tantalum nitride (TaN).

The deposition of the resistor material for the resist layer 18 may be provided through an evaporative deposition process where the substrate 12 is placed in a vacuum with a source for the resistor material. When under a vacuum and at a desired temperature, the resistor material evaporates from the source and condenses on the resist layer 18 and those portions of the substrate 12 that are exposed through the openings in the resist layer 18 to form the thin film resistor layer 20.

Figure 6:
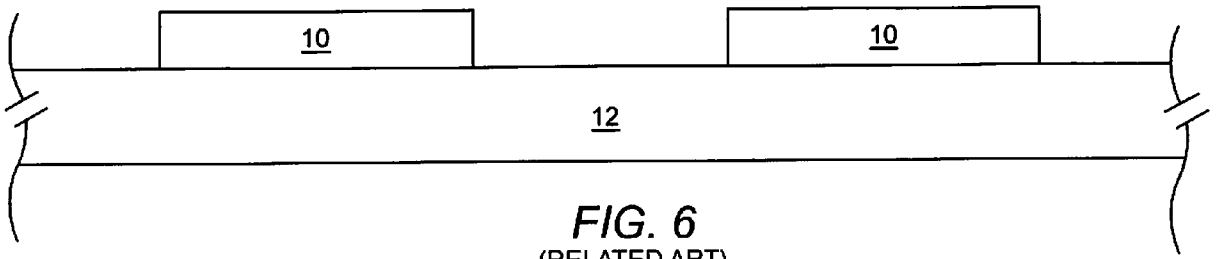
FIG. 6 (RELATED ART)

Next, the substrate 12 is brought back to atmospheric conditions and subjected to a lift-off process to remove the remaining portions of the resist layer 18. Notably, removal of the resist layer 18 also removes those portions of the thin film resistor layer 20 that reside over the remaining portions of the resist layer 18. The portions of the thin film resistor layer 20 that were formed on the substrate 12 remain and represent the thin film resistors 10. FIG. 6 illustrates the two thin film resistors 10 on the substrate 12 after completion of the lift-off process.

As those skilled in the art will appreciate, numerous lithography processes are employed when fabricating a semiconductor device. After forming the thin film resistors 10 or other devices in subsequent lithography processes, special cleaning processes are often employed to remove residual organic compounds that may affect the ability of subsequent layers to adhere to or make contact with exposed surfaces throughout the fabrication process. These residual organic compounds are often remnants or debris from the resist layer 18 or other resist layers that remain after completion of previous deposition and lift-off steps.

Figure 7:
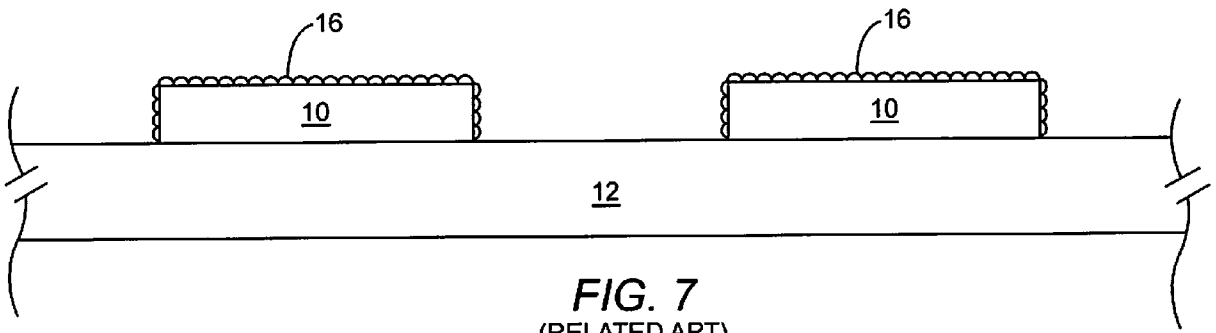
FIG. 7 (RELATED ART)

A particularly effective cleaning process is referred to as "ashing." Ashing is the process of exposing the substrate 12 and the components formed thereon to a plasma, such as an oxygen or nitrous oxide plasma, to remove the residual organic compounds that may affect the ability of subsequent layers to adhere to or make contact with exposed surfaces at any given point in the fabrication process. Unfortunately, the oxygen present in plasma reacts with the exposed portions of the thin film resistors 10, and as a result, the oxide layer 16 forms over the exposed portions of the thin film resistors 10, as shown in FIG. 7. Relative to the resistivity of the thin film resistors 10, the resistivity of the oxide layer 16 is very high.

Figure 8:
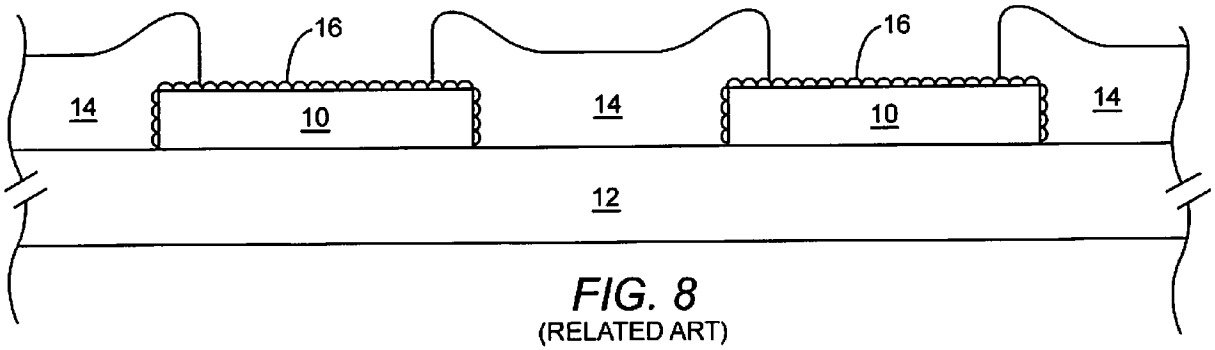
FIG. 8 (RELATED ART)

When the interconnects 14 to and between the thin film resistors 10 are formed, as shown in FIG. 8, the portions of the interconnects 14 that are intended to directly contact the resistive material of the thin film resistors 10 actually contact the oxide layer 16. As such, there is a high resistivity oxide layer 16 injected in electrical series between the interconnects 14 and the thin film resistors 10. As such, the effective resistance between any pair of interconnects 14 (or other components) can be significantly higher than the resistance that the thin film resistors 10 were designed to provide.

The subject of the present disclosure provides a technique that prevents the oxide layer 16 from forming on at least part of the thin film resistor 10, such that the interconnects 14 make contact with those parts of the thin film resistor 10 that have not oxidized. A thin film resistor 22 that is fabricated according to one embodiment of the present disclosure is illustrated in FIG. 9.

Notably, different reference numbers are used to help distinguish the subject of the present disclosure from that which was described above.

Figure 9:
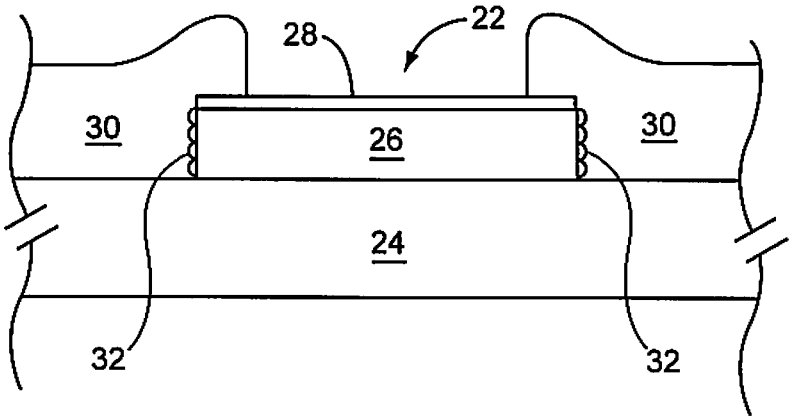
FIG. 9 illustrates a thin film resistor according to one embodiment of the disclosure.

As depicted in FIG. 9, the thin film resistor 22 is formed on a substrate 24. The thin film resistor 22 is formed of at least two components: a primary resistor segment 26 that resides over the substrate 24 and a protective cap 28 that resides over the top surface of the resistor segment 26. The resistor segment 26 is formed from a resistor material that is typically used for forming thin film resistors, such as but not limited to chromium (Cr), nickel (Ni), nichrome (NiCr), titanium (Ti), gold-germanium-nickel alloy (AuGeNi), and tantalum nitride (TaN). The embodiments disclosed herein are particularly applicable when forming the resistor segment 26 from resistor materials that are prone to oxidation during fabrication.

The protective cap 28 is formed from a low resistivity material that is not prone to oxidation. Exemplary materials for the protective cap 28 include metals such as platinum, and noble metals such as tantalum (Ta) and iridium (Ir).

As described in further detail below, the protective cap 28 is formed over all or a portion of the top surface of the resistor segment 26 prior to any oxide inducing processes, such as ashing, that take place after the resistor segment 26 is formed. As such, the protective cap 28 prevents oxidation of at least a portion of the resistor segment 26, and provides lower-resistivity points of contact for the thin film resistor 22.

In the illustrated example, the protective cap 28 covers the entire top surface of the resistor segment 26 but does not extend over the sides of the resistor segment 26. As such, the sides of the resistor segment 26 may be exposed to subsequent ashing processes, and as a result, may develop an oxide layer 32. Alternatively, the protective cap 28 may be formed to cover the sides of the resistor segment 26 in addition to the top surface to prevent oxidation of the sides of the resistor segment 26 during subsequent ashing processes. With this configuration, any portion of the protective cap 28 provides a lower-resistivity point of contact to the resistor segment 26, and thus the thin film resistor 22 in general.

As illustrated, each of the interconnects 30 is formed to make contact with an outer portion of the top surface and a corresponding side of the thin film resistor 22. In particular, the respective interconnects 30 make contact with an outer portion of the top surface and corresponding side of the protective cap 28 as well as the oxide layer 32 that has formed on the corresponding side of the resistor segment 26. The portions of the protective cap 28 that are in contact with the respective interconnects 30 provide lower-resistivity points of contact to the resistor segment 26. While the portions of the oxide layers 32 that are in contact with the respective interconnects 30 provide relatively higher-resistivity points of contact to the resistor segment 26, these higher-resistivity points of contact have little or no impact due to the presence of the lower-resistivity points of contact. The lower interlevel contact resistance between the resistor segment 26 and the interconnect 30 through the protective cap 28 is on the order of about 0.01 ohm•mm to 0.25 ohm•mm, while the high interlevel contact resistance between the resistor segment 26 and the interconnect 30 through the oxide layer 32 may be on the order of 0.75 ohm•mm or greater.

An exemplary process for forming the thin film resistor 22 is described below. In the following example, two thin film resistors 22 are formed beside each other and will ultimately be connected to each other and to other components (not shown) using the corresponding interconnects 30.

Figure 10:
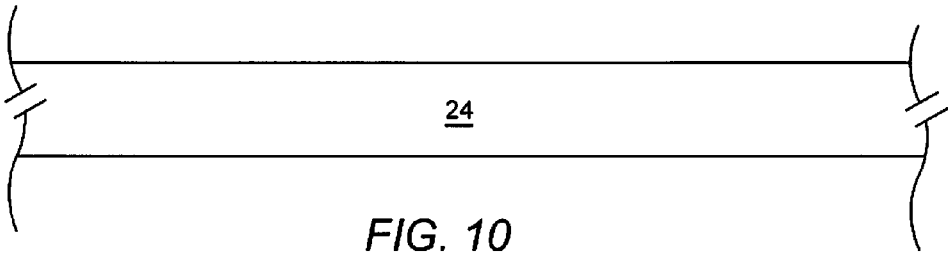
FIGS. 10 through 17 graphically illustrate an exemplary fabrication process for forming the thin film resistor of FIG. 9.
Figure 11:
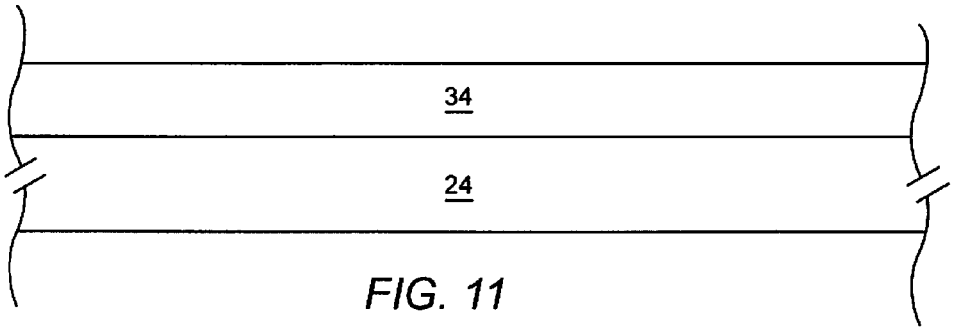

Initially, the fabrication process begins with providing a substrate 24, such as a Silicon Carbide, Gallium Nitride, Gallium Arsenide, or like substrate, as shown in FIG. 10. A lithography process is used to form the thin film resistor 22. In this example, the lithography process employed is a photolithography process where a photosensitive resist material is initially deposited over the substrate 24 to provide a resist layer 34, as shown in FIG. 11. The resist material may include, but is not limited to, positive and negative photoresists.

Figure 12:
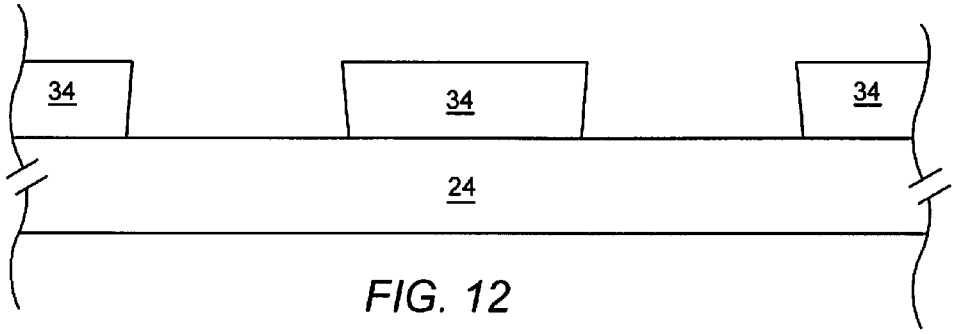

Next, the resist layer 34 is irradiated with light that is projected through a photomask that defines the locations where the thin film resistors 22 will be formed. After irradiation, the resist layer 34 is exposed to a developer solution to remove the irradiated portions that correspond to the locations where the thin film resistors 22 will be formed. Exemplary developer solutions include, but are not limited to Metal ion developers, such as potassium hydroxide (KOH) or metal ion free developer such as tetramethylammonium hydroxide (TMAH). The resulting openings in the resist layer 34 for the thin film resistors 22 are shown in FIG. 12.

Figure 13:
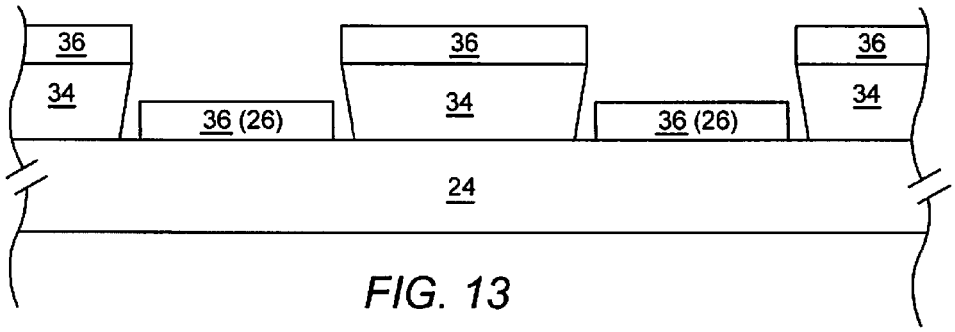

Next, resistor material is deposited over the resist layer 34 and those portions of the substrate 24 that are exposed through the openings in the resist layer 34. The deposited resistor material forms a thin film resistor layer 36, as illustrated in FIG. 13. A typical resistor material is formed from chromium (Cr), nickel (Ni), or nichrome(NiCr). Other resistor materials include, but are not limited to Tantalum nitride (TaN). The resistive materials that are prone to oxidation are chromium (Cr), nickel (Ni), nichrome and titanium (Ti).

The deposition of the resistor material for the thin film resistor layer 36 may be provided through an evaporative deposition process where the substrate 24 is placed in a vacuum with a source for the resistor material. When under a vacuum and at a desired temperature, the resistor material evaporates from the source and condenses on the resist layer 34 and those portions of the substrate 24 that are exposed through the openings in the resist layer 34 to form the thin film resistor layer 36. Exemplary deposition conditions include a vacuum in the range of about 0.5 to $1\times10^{-7}$ Torr and a temperature in the range of about 20° C. to 150° C.

Figure 14:
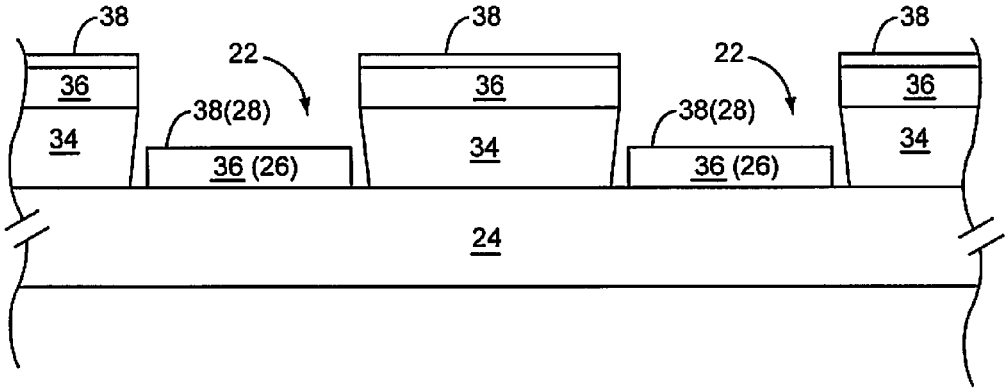

Without removing the vacuum and as shown in FIG. 14, a protective cap material is deposited over the thin film resistor layer 36, including over those portions of the thin film resistor layer 36 that reside in the openings of the resist layer 34, to form a protective cap layer 38. The protective cap material may be formed from an inherently highly resistive and environmentally inert metal, alloy, or compound. In certain embodiments, inherently highly resistive and environmentally inert metals, including but not limited to platinum, tantalum (Ta) (13E-6 ohm•cm), and iridium (Ir) (4.7E ohm•cm) are used to form the protective cap layer 38. In one embodiment, the interlevel contact resistance associated with the protective cap material is at least an order of magnitude less than that of the oxide layer 32.

Figure 15:
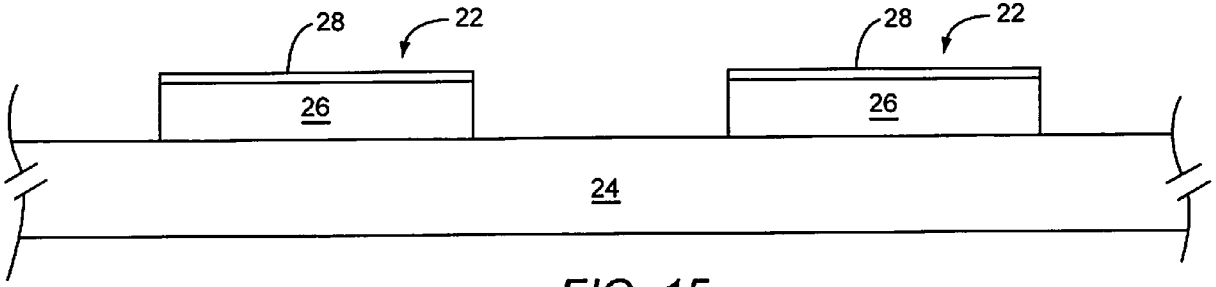

Next, the substrate 24 is brought back to atmospheric conditions and subjected to a lift-off process to remove the remaining portions of the resist layer 34. Removal of the resist layer 34 also removes those portions of the thin film resistor layer 36 and the protective cap layer 38 that reside over the remaining portions of the resist layer 34. The portions of the thin film resistor layer 36 and the protective cap layer 38 that were formed on the substrate 24 remain and represent the respective resistor segments 26 and protective caps 28 of the two thin film resistors 22. FIG. 15 illustrates the two thin film resistors 22 on the substrate 24 after completion of the lift-off process.

In select embodiments, the resistor segments 26 are substantially planar and between about 800 and 1000 Angstroms thick, but may also range between about 100 and 10,000 Angstroms thick. In these embodiments, the sheet resistance of the resistor segments 26 may be between about 2 ohms/square and 50 ohms/square; 2 ohms/square and 100 ohms/square; and 9 ohms/square and 20 ohms/square.

The protective caps 28 are much thinner than the resistor segments. In select embodiments, the protective caps 28 are substantially planar and between about 5 and 100 Angstroms thick, but may also range between about 20 and 80 Angstroms and 40 and 60 Angstroms thick. In these embodiments, the sheet resistance of the protective caps 28 may be between about 20 ohms/square and 150 ohms/square and between about 30 ohms/square and 50 ohms/square.

In certain embodiments, the protective caps 28 represent between about 5 and 15% of the combined thickness of the protective caps 28 and the resistor segments 26. The resistor segments 26 may represent between about 85 and 95% of the combined thickness of the protective caps 28 and the resistor segments 26. For one embodiment of the thin film resistor 22, the resistor segment 26 is formed from nichrome and represents around about 90% of the combined thickness of the protective cap 28. Further, the protective cap 28 is formed from platinum and represents around about 10% of the combined thickness of the protective cap 28. Notably, the resistor segments 26 and the protective caps 28 may represent a single layer or multiple layers of the same or different materials. Additional layers may be provided between the resistor segments 26 and the protective caps 28.

Figure 16:
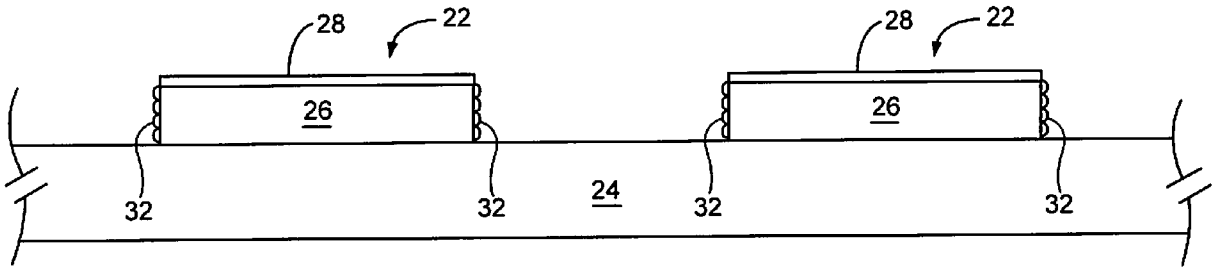

Once the thin film resistor 22 is formed, the substrate 24 may be subjected to an ashing process, or other appropriate cleaning processes, to remove any residual organic compounds that may affect the ability of subsequent layers to adhere to or make contact with any exposed surfaces of the substrate 24 and the thin film resistor 22. These residual organic compounds may be left over from the process of forming the thin film resistor 22 or other components (not shown) on the substrate 24. The oxygen present in the plasma associated with the ashing process may also react with the exposed side portions of the resistor segments 26, and as a result, the oxide layers 32 form on the exposed side portions of the resistor segments 26, as shown in FIG. 16. However, the protective cap 28 of the thin film resistor 22 will not oxidize, and as such, an oxide layer 32 will not form on the top or side surfaces of the protective cap 28 or the top surface of the resistor segment 26, since it is covered by the protective cap 28. In an alternate embodiment, the protective cap 28 may be formed over the exposed sides of the resistor segments 26 in an effort to prevent the oxide layers 32 from being formed thereon.

Figure 17:
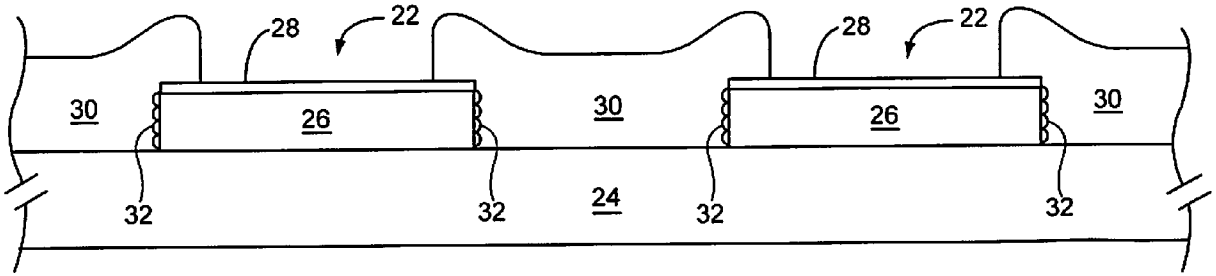

Next, the interconnects 30 that connect to and between the thin film resistors 22 are formed, as shown in FIG. 17. Each end portion of an interconnect 30 that makes contact with the thin film resistor 22 makes direct contact with both a portion of the resistor segment 26 and the protective cap 28 of the thin film resistor 22. As illustrated, each of the interconnects 30 is formed to make contact with an outer portion of the top surface and a corresponding side of one or more of the thin film resistors 22. For each connection, the respective interconnect 30 makes contact with an outer portion of the top surface and corresponding side of the protective cap 28 as well as the oxide layer 32 that has formed on the side of the resistor segment 26. The portions of the protective cap 28 that are in contact with the respective interconnects 30 provide lower-resistivity points of contact to the resistor segment 26. As such, the portions of the oxide layers 32 that are in contact with the respective interconnects 30 and provide relatively higher-resistivity points of contact to the resistor segment 26 have little impact on the overall interlevel contact resistance.

Those skilled in the art will recognize improvements and modifications to the embodiments of the present disclosure. All such improvements and modifications are considered within the scope of the concepts disclosed herein and the claims that follow.

What is claimed is:

1. An apparatus comprising:

a substrate;

a resistor segment on the substrate;

a protective cap on the resistor segment wherein the resistor segment and the protective cap form a thin film resistor and there is essentially no oxide layer formed between the resistor segment and the protective cap.

2. The apparatus of claim 1 wherein the protective cap has a first surface and further comprising a first interconnect having a first end in contact with at least a first portion of the first surface.

3. The apparatus of claim 2 further comprising a second interconnect having a second end in contact with at least a second portion of the first surface wherein a majority of current flowing through the thin film resistor flows through the resistor segment.

4. The apparatus of claim 2 wherein an unprotected surface of the resistor segment of the thin film resistor that is not covered by the protective cap has an oxide layer and the first end is in further contact with the oxide layer.

5. The apparatus of claim 1 wherein the resistor segment is formed from a resistor material that is prone to oxidation.

6. The apparatus of claim 5 wherein the protective cap is formed from a protective cap material that is not prone to oxidation.

7. The apparatus of claim 6 wherein the protective cap material comprises platinum.

8. The apparatus of claim 7 wherein the protective cap material consists essentially of platinum.

9. The apparatus of claim 5 wherein the resistor material comprises one of a group consisting of nickel, chromium, and nichrome.

10. The apparatus of claim of claim 5 wherein a thickness of the protective cap of the thin film resistor is less than about 15% of a combined thickness of the protective cap and the resistor segment.

11. The apparatus of claim 10 wherein a thickness of the resistor segment of the thin film resistor is greater than about 85% of a combined thickness of the protective cap and the resistor segment.

12. The apparatus of claim 5 wherein the resistor segment of the thin film resistor is between about 800 and 1000 Angstroms thick and the protective cap is less than about 100Angstroms thick.

13. The apparatus of claim 5 wherein the protective cap comprises platinum and the resistor segment comprises one of a group consisting of nickel, chromium, and nichrome.

14. An apparatus comprising:

a substrate;

a resistor segment on the substrate;

a protective cap directly on the resistor segment wherein the resistor segment and the protective cap form a thin film resistor; and a contact on the protective cap.

15. The apparatus of claim 14 wherein there is essentially no oxide layer formed between the resistor segment and the protective cap.

16. The apparatus of claim 15 wherein the protective cap comprises platinum and the resistor segment comprises one of a group consisting of nickel, chromium, and nichrome.

* * * * *